US007065796B2

(12) United States Patent
Watkins et al.

(10) Patent No.: US 7,065,796 B2
(45) Date of Patent: Jun. 27, 2006

(54) FIRE PROTECTIVE TROUSERS EXHIBITING REDUCED BINDING

(75) Inventors: Susan Watkins, Ithaca, NY (US); Mark Mordecai, Hampton, NH (US); Mike Towle, Pittsfield, NH (US)

(73) Assignee: Globe Manufacturing Co., Pittsfield, NH (US)

( * ) Notice: Subject to any disclaimer, the term of this patent is extended or adjusted under 35 U.S.C. 154(b) by 182 days.

(21) Appl. No.: 10/823,782

(22) Filed: Apr. 14, 2004

(65) Prior Publication Data

US 2005/0229292 A1 Oct. 20, 2005

(51) Int. Cl.
*A41D 1/06* (2006.01)
*A41D 13/02* (2006.01)

(52) U.S. Cl. ..... 2/227; 2/243.1

(58) Field of Classification Search ..... 2/227, 2/228, 238, 114, 79, 69, 69.5, 80, 83, 78.1–78.4, 2/81, 82; D2/742–748
See application file for complete search history.

(56) References Cited

U.S. PATENT DOCUMENTS

D223,077 S * 3/1972 Benrube ..... D2/742
4,918,760 A * 4/1990 Grilliot et al. ..... 2/227
5,035,007 A * 7/1991 Grilliot et al. ..... 2/227
5,131,098 A * 7/1992 Grilliot et al. ..... 2/227
5,247,708 A * 9/1993 Freese, Jr. ..... 2/79
5,402,539 A * 4/1995 Hewitt ..... 2/227
5,943,699 A * 8/1999 Barbeau ..... 2/81

* cited by examiner

*Primary Examiner*—Gloria M. Hale
(74) *Attorney, Agent, or Firm*—Dykema Gossett PLLC

(57) ABSTRACT

Fire protective trousers include an outer shell and a removable liner, the outer shell having right and left front panels which extend around and behind the center sides of the outer shell and connect with respective right and left rear panels along outseams at the rear of the outer shell, thus providing more material in the front of the outer shell and reducing rubbing contact with the body of the wearer. The respective inseams curve to the rear and down to the lower edges of the rear panels. The right and left front panels also include respective upper and lower pleats that extend from the outseams toward the inseams and from the inseams toward the outseams thereof to provide extra material in the knee areas of the leg portions. The rear panels have concave lower edges to reduce dragging on the ground and the possibility of being stepped on by the wearer. The center rear seam is at least 6 inches longer than the center front seam to provide extra room in the buttocks area of the trousers and reduce binding in the thigh and abdomen areas of the wearer.

19 Claims, 5 Drawing Sheets

FIRE PROTECTIVE TROUSERS EXHIBITING REDUCED BINDING

BACKGROUND OF THE INVENTION

1. Field of the Invention

The present invention relates to fire protective apparel, and in particular to fire protective trousers which may be worn by firefighters, emergency responders and rescue workers.

2. The Prior Art

Fire protective trousers are routinely worn by firefighters, rescue workers and emergency responders for protection against the flames and heat of fires and to help protect the wearer from the water used to extinguish the fires. Conventional fire protective trousers include an outer shell made of a fire protective material and a liner which is removably positioned in the outer shell and which is formed of an outer layer of a moisture barrier material and an inner layer of a thermal material. However, such trousers can be uncomfortable to wear and restrictive to the wearer's movements because the areas thereof covering the wearer's abdomen, thighs, buttocks and knees can rub or bind against the wearer when he (or she) squats or sits, and in many instances the lower edges of the leg portions thereof can drag on the ground and be inadvertently stepped on during use.

A need exists for fire protective trousers which will reduce binding in the thigh and leg areas of the wearer during use and which will have leg portions whose lower edges are less likely to contact the ground and be possibly stepped on by the wearer.

SUMMARY OF THE INVENTION

According to this invention, a pair of fire protective trousers is provided wherein the front panels of the outer shell, as well as the front panels of both the outer and inner layers of the removable liner, are elongated in width so as to respectively extend around the sides of the trousers and connect with rear panels along outer seams in the rear of the trousers. In addition, inseams connecting the respective front panels of the outer shell (and the front panels of the layers of the liner) with associated rear panels extend downwardly from crotch areas thereof and curve rearwardly to the back of the respective leg portions and down to the lower edges of the rear panels.

This construction provides wide front panels of the outer shell and both layers of the removable liner, which results in greater available room, as compared to conventional trousers, within the respective leg portions to accommodate knee bending of the wearer while preventing excess material bulk in the rear of the leg portions.

According to another feature of the invention, the right and left leg portions of the front panels of the outer shell include respective upper and lower pleats which extend towards each other from the respective outseams and inseams thereof, and both the outer and inner layers of the liner include upper and lower darts in their front panels which extend towards one another from their respective outseams and inseams, the pleats in the outer shell and the darts in the outer and inner layers of the removable liner cooperating to provide additional material in the knee areas of the trousers to accommodate knee bending, thus further reducing trouser binding.

According to another feature of the invention, the rear panels of the outer shell and the outer and inner layers of the removable liner are shaped so that the rear center seams connecting the panels together are longer than in known constructions, thus providing extra material in the buttocks area of the wearer, which will reduce binding in thigh areas of the wearer.

According to a still further feature of the invention, the lower edges of the rear panels of the leg portions of the outer shell are concave in shape, as are the lower edges of both the front and rear panels of the leg portions of both the outer and inner layers of the removable liner, to reduce the possibility of dragging on the ground when the trousers are being worn, as well as the possibility of being stepped on by the wearer.

A better understanding of the invention will be had by reference to the attached drawings, taken in conjunction with the following discussion.

DETAILED DESCRIPTION OF THE PREFERRED EMBODIMENTS

Figure 1:
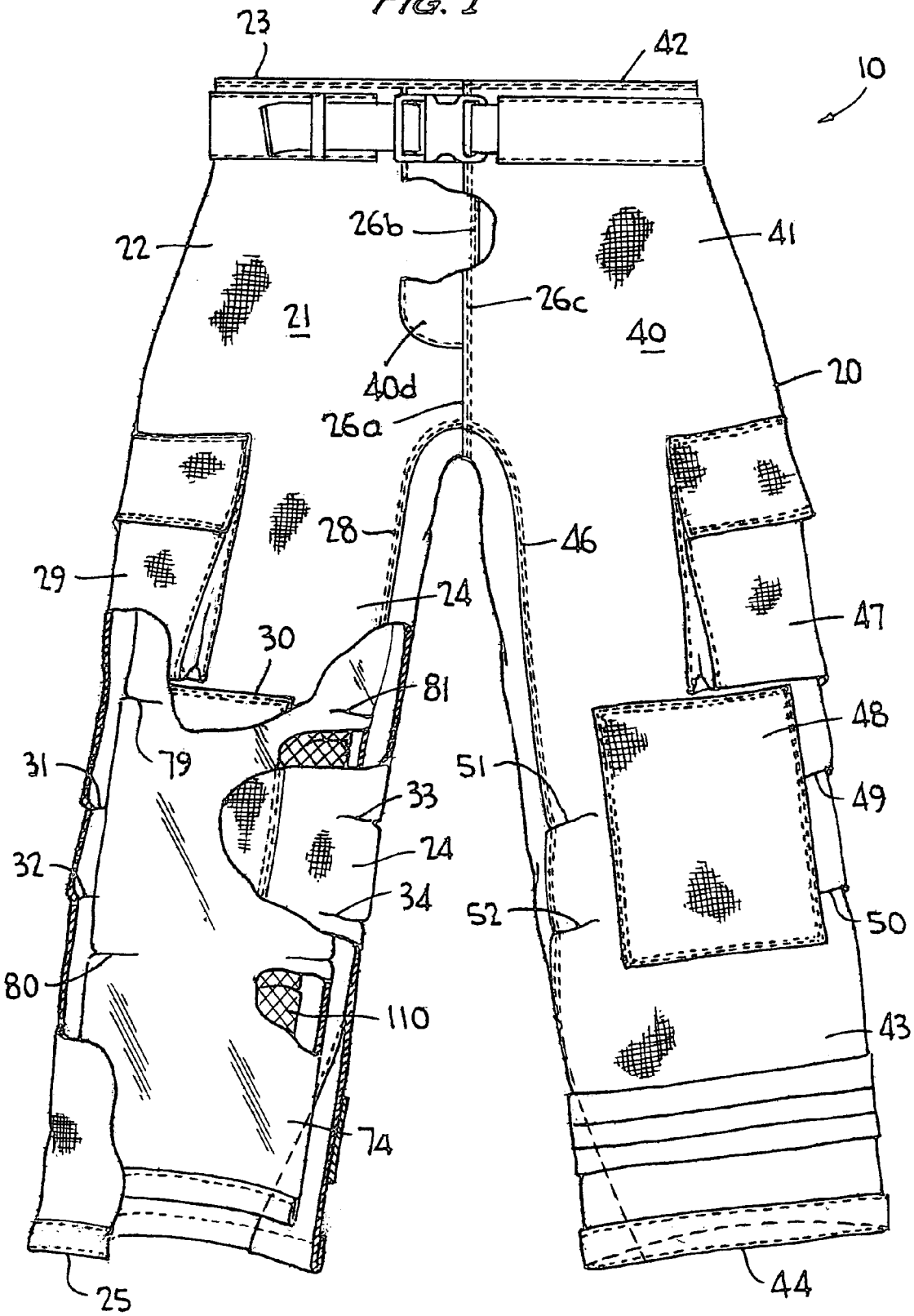
FIG. 1 is a front view of a pair of fire protective trousers according to a preferred embodiment of the present invention, a portion of the outer shell of the right leg thereof being broken away to show the right leg of the removable liner therein.
Figure 2:
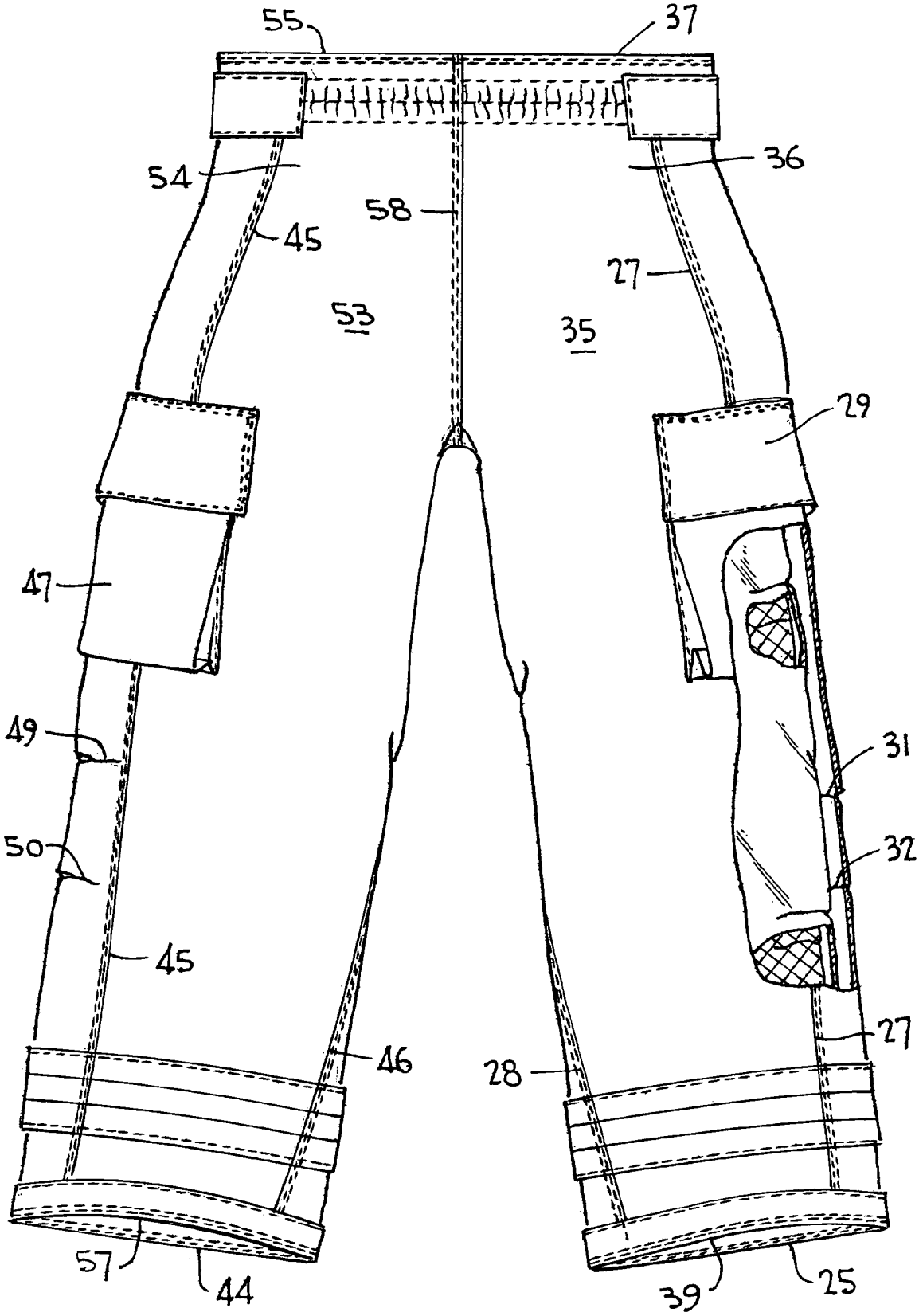
FIG. 2 is a rear view of the fire protective trousers of FIG. 1, a portion of the outer shell of the right leg thereof being broken away to show the right leg of the removable liner therein.
Figure 3:
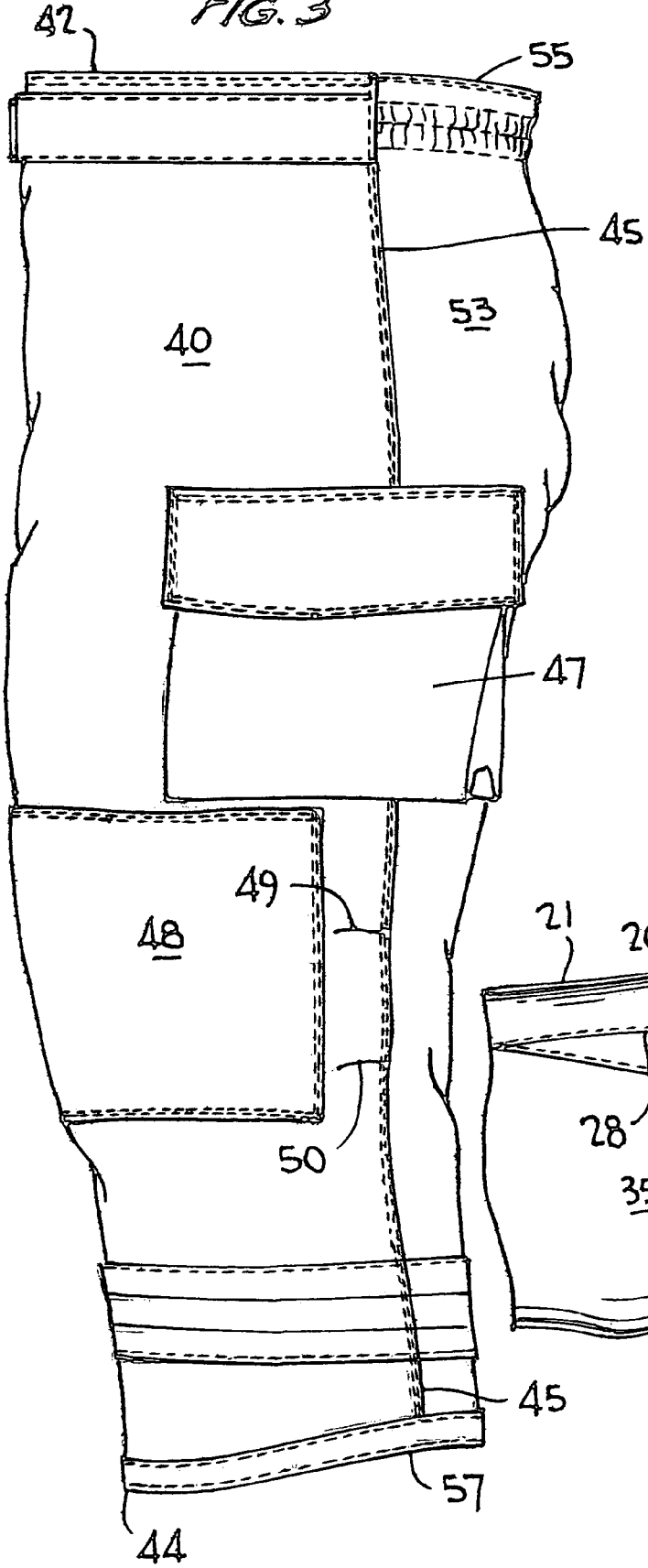
FIG. 3 is a left side view of the fire protective trousers of FIG. 1.

A pair of fire protective trousers according to a preferred embodiment of the present invention is generally labeled 10 in FIGS. 1–3. It includes an outer shell 20 made of a fire protective material and a removable liner 60 which includes an outer layer 70 made of a moisture barrier material and an inner layer 110 made of a thermal material (see FIGS. 5 and 6). The inner and outer layers 70 and 110 can be sewn together around their peripheries or detachably connected with fastening means such as snap fasteners or hook and loop strips (not shown) that can be located in spaced positionings around their corresponding peripheries, in particular around their upper edges.

The outer shell 20 includes a right front panel 21, a right rear panel 35, a left front panel 40 and a left rear panel 53. The right front panel 21 includes an upper portion 22 that defines a generally straight upper edge 23 and a leg portion 24 that defines a generally straight lower edge 25. The left front panel 40 includes an upper portion 41 that defines a generally straight upper edge 42 and a leg portion 43 that defines a generally straight lower edge 44. The right rear panel 35 includes an upper portion 36 that defines a generally straight upper edge 37 and a leg portion 38 that defines a concave or cupped lower edge 39. The left rear panel 53 includes an upper portion 54 that defines a generally straight upper edge 55 and a leg portion 56 that defines a concave or cupped lower edge 57. The concave lower edges 39 and 57 result in increased spacing between the lower edges of the leg portions 38 and 56 and the ground and reduced likelihood that these lower edges will drag on the ground and be stepped on by a wearer.

Figure 4:
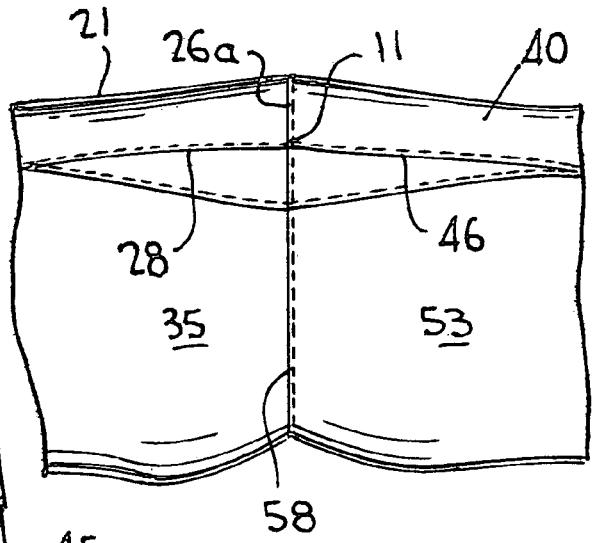
FIG. 4 is a bottom view of the crotch area of the outer shell of the fire protective trousers of FIG. 1.

The upper portion 22 of the right front panel 21 is connected to the upper portion 41 of the left front panel 40 by a center front seam 26 having a lower portion 26*a* that extends from a crotch point 11 (see FIG. 4) upwardly to a fly area where it splits into an upper branch 26*b* that extends along the upper portion 22 of the right front panel 21 to the upper edge 23 and an upper portion 26*c* that extends along the upper portion 41 of the left front panel 40 to the upper edge 42. The fly area can be closed by conventional fastening means (not shown) and covered by a protective flap 40*d*.

The right front panel 21 is connected to the right rear panel 35 along a right outseam 27 that is located rearwardly of a center right side of the outer shell, i.e., in a right rear thereof (see FIG. 2). The right front panel is also connected to the right rear panel 35 along an inseam 28 that extends downwardly from the crotch point 11 and curves or "rolls" rearwardly to the back of the right leg of the outer shell and down to the lower edge 39. The right front panel 21 is wider than the right rear panel when both are flattened out.

A right pocket 29 is attached to the right front panel 21 and to the right rear panel 35 so as to extend over the right outseam 27. A right knee pad 30 is attached to the leg portion 24 to extend beneath the right pocket 29.

The right leg portion 24 includes respective upper and lower pleats 31 and 32 which extend from the right outseam 27 toward the knee pad 30 and respective upper and lower pleats 33 and 34 which extend from the right inseam 28 toward the knee pad 30. The upper pleats 31 and 33 are in register with one another, as are lower pleats 32 and 34. These pleats, as well as the location of the right outseam 27 and the right inseam 28, enable the right front panel to include extra material that results in reduced binding against a wearer's thigh and right knee when the wearer is walking and bending.

The left front panel 40 is connected to the left rear panel 53 along a left outseam 45 that is located rearwardly of a center left side of the outer shell, i.e., in the left rear thereof. The left front panel is also connected to the left rear panel along an inseam 46 that extends downwardly from the crotch point 11 and curves or "rolls" rearwardly to the back of the left leg of the outer shell and down to the lower edge 57. The left front panel 40 is wider than the left rear panel 53 when both are flattened out.

A left pocket 47 is attached to the left front panel 40 and the left rear panel 53 so as to extend over the left outseam 45. A left knee pad 48 is attached to the leg portion 56 to extend beneath the left pocket 47.

The left leg portion 43 includes respective upper and lower pleats 49 and 50 which extend from the left outseam 45 toward the left knee pad 48 and respective upper and lower pleats 51 and 52 which extend from the left inseam 46 toward the left knee pad 48. The upper pleats 49 and 51 are in register, as are lower pleats 50 and 52. These pleats, as well as the location of the left outseam 45 and the left inseam 46, enable the left front panel 40 to include extra material that results in reduced binding against a wearer's thigh and left knee when the wearer is walking and bending.

The left rear panel 53 is connected to the right rear panel 35 along a center rear seam 58 which extends rearwardly from crotch point 11 up to the upper edges 37, 55 of the panels 35 and 51 (the crotch point 11 is where the center front and center rear seams 26, 58 intersect with the right and left inseams 28 and 46).

Due to the shape of the right and left rear panels 35 and 51, the length of the center rear seam 58 will be at least 6 inches longer than the length of the center front seam (length of seam 26*a* plus length of seams 26*b* or 26c). The right and left rear panels are thus cut to provide supplemental material in the buttocks area of a wearer and thereby reduce binding against a wearer's thighs and abdomen when worn.

Figure 5:
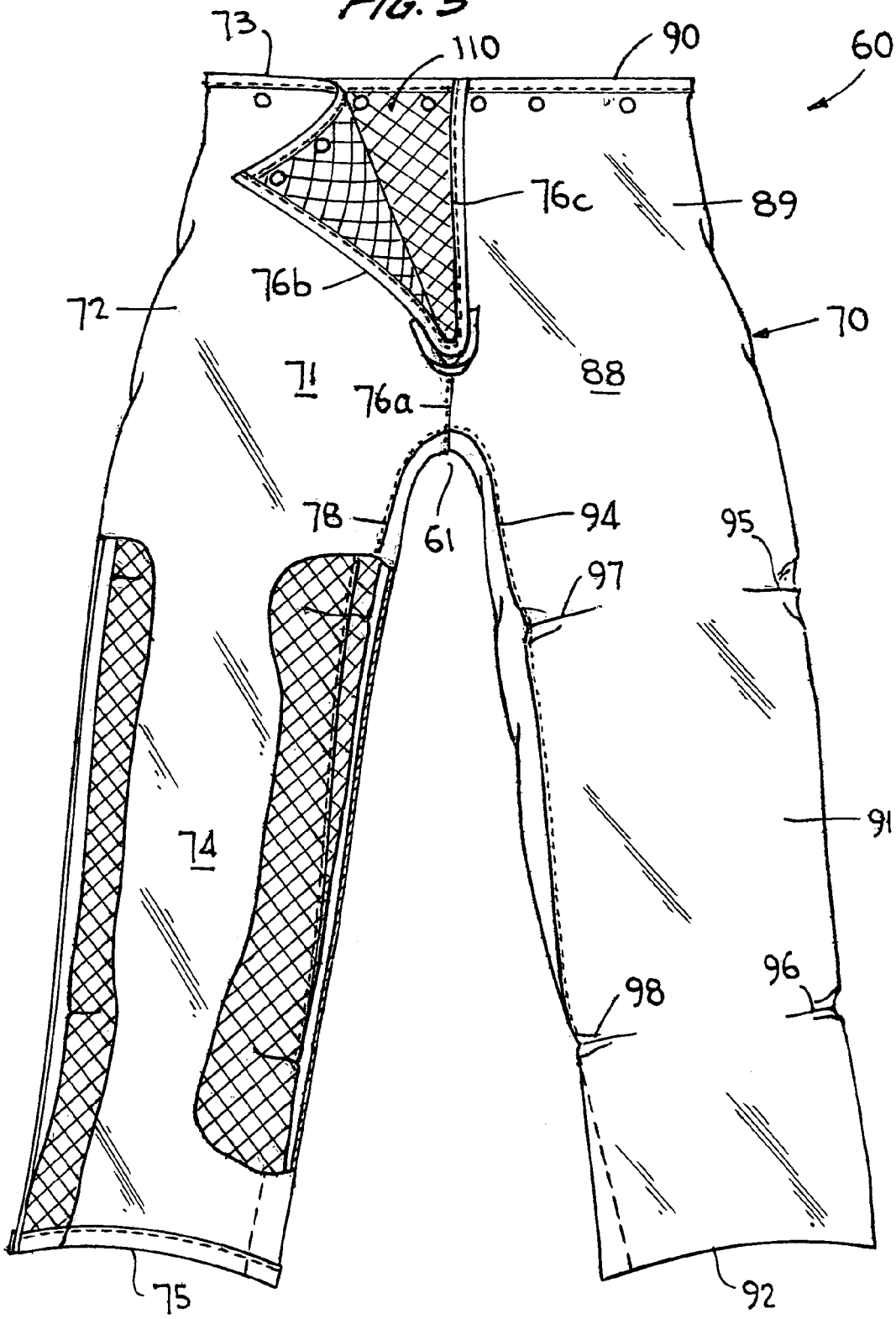
FIG. 5 is a front view of the removable liner of the fire protective trousers of FIG. 1 with portions of the outer layer thereof being broken away to show the inner layer therewithin.
Figure 6:
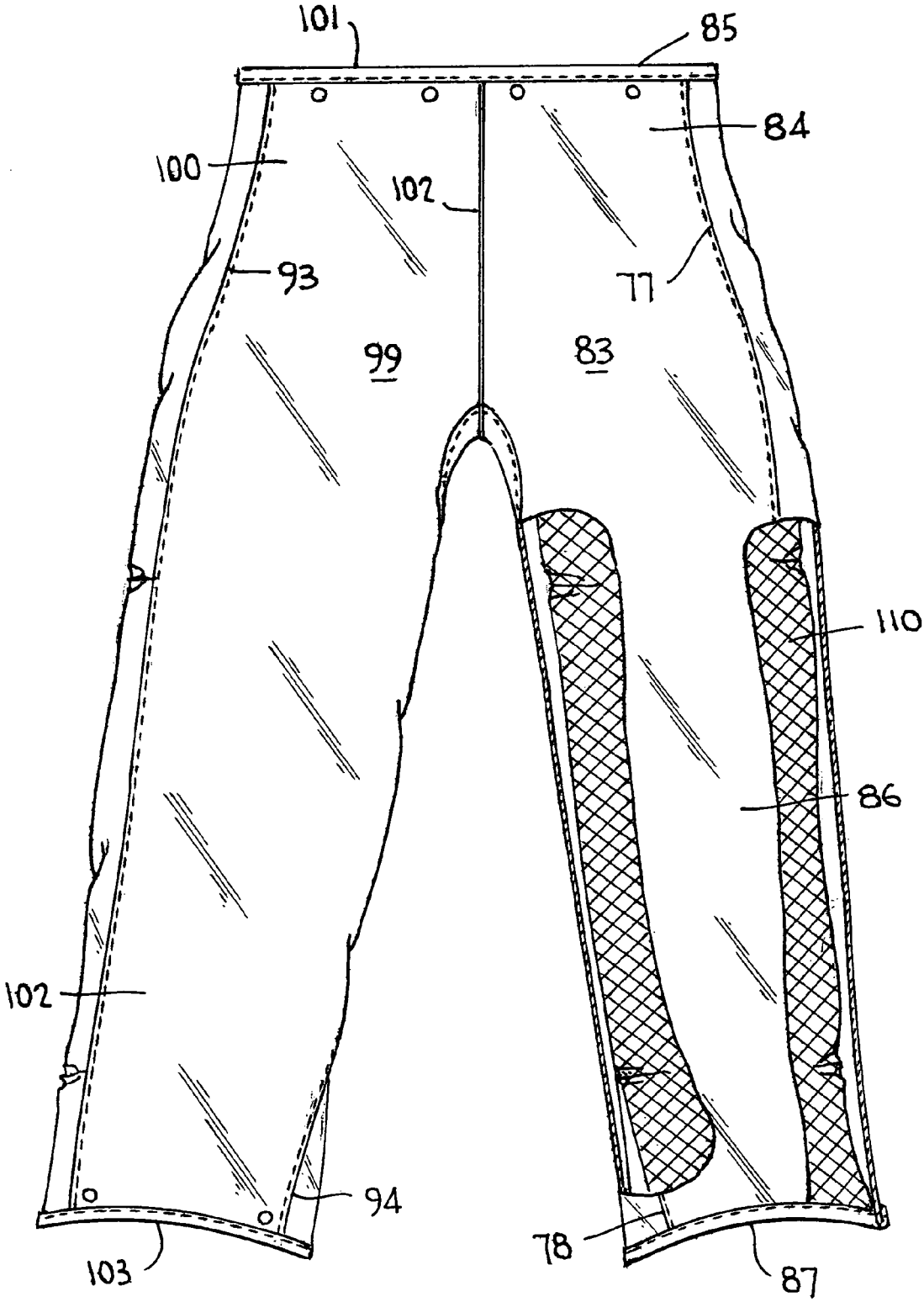
FIG. 6 is a rear view of the removable liner of FIG. 5 with portions of the outer layer thereof being broken away to show the inner layer therewithin.

FIGS. 5 and 6 depict the removable liner 60 that is attachable inside the outer shell 20, this liner including a outer layer 70 and an inner layer 110.

The outer layer 70 includes a right front panel 71, a right rear panel 83, a left front panel 88 and a left rear panel 99. The right front panel 71 defines an upper portion 72 that defines a generally straight upper edge 73 and a leg portion 74 that defines a concave lower edge 75. The left front panel 88 defines an upper portion 89 that defines a generally straight upper edge 90 and a leg portion 91 that defines a concave lower edge 92. The right rear panel 83 defines an upper portion 84 that defines a generally straight upper edge 85 and a leg portion 86 that defines a concave lower edge 87. The left rear panel 99 defines an upper portion 100 which defines a upper edge 101 and a leg portion 102 that defines a concave lower edge 103.

The upper portion 72 of the right front panel 71 is connected to the upper portion 89 of the left front panel 88 along a center front seam 76*a* which extends up to a fly area between the panels and then splits into seams 76*b* and 76*c* which extend upwardly along the side edges of respective panels 71 and 88 to the upper edges 73, 90 of the panels.

The right front panel is connected to the right rear panel 83 along a right outseam 77 that is located rearwardly of a center right side of the outer layer. The right front panel 71 is also connected to the right rear panel 83 along a right inseam 78 that extends from the crotch area 61 of the outer layer downwardly and so as to curve or "roll" rearwardly to the rear of the leg portion and to the lower edge 87 of the right rear panel 83.

The left front panel 88 is connected to the left rear panel 99 along a left outseam 93 that is located rearwardly of a center left side of the outer layer and a left inseam 94 that extends from the crotch area 61 downwardly and so as to curve or "roll" rearwardly to the rear of the leg portion and to the lower edge 103 of the left rear panel 99. The left rear panel 99 is connected to the right rear panel 83 along a center rae seam 104.

As seen in FIG. 1, the right front panel 71 includes respective upper and lower darts 79, 80 which extend from the right outseam 77 toward the right inseam 78 and respective upper and lower darts 81, 82 that extend from the right inseam 78 toward the right outseam 77. The upper darts 79, 81 are in register, as are the lower darts 80,82. When the liner 60 is inserted in the outer shell 20, the upper darts 79,81 will be locate above the upper pleats 31,33 in the right front panel 21 of the outer shell 20 and the lower darts 80,82 will be located below the lower pleats 32,34 in the right front panel 21. The darts in the right leg portion of the outer layer 70 provide additional panel material therebelow to cooperate with the pleats in the leg portion of the outer shell to reduce binding action on the right leg of the wearer of the trousers.

As seen in FIG. 5, the left front panel 88 includes respective upper and lower darts 95, 96 which extend from the left outseam 93 toward the left inseam 94 and respective upper and lower darts 97,98 which extend from the left inseam 94 toward the left outseam 93. The upper darts 95,97 are positioned above the upper pleats 49,51 in the left front panel 40 of the outer shell when the layer 70 is mounted within the outer shell 20, and the lower darts 96,98 are positioned below the lower pleats 50,52. These darts provide additional panel material to cooperate with the pleats in the left leg portion of the outer shell to reduce binding against the leg of a wearer.

The center rear seam 104 is at least 6 inches longer than the length of the center front seam (length of seam 76*a* plus length of seams 76*b* or 76*c*) similarly to the situation with the center front and center rear seams in the outer shell 20.

The inner layer 110 of the removable liner 60 is constructed similarly the outer layer 70, except that upper and lower darts in the right and left leg portions thereof are respectively located below the corresponding darts in the leg portions of the outer layer (see FIG. 1).

Although a detailed description of a preferred embodiment of the present invention has now been presented, modifications therein can be made and still fall within the scope of the appended claims.

We claim:

1. A pair of fire protective trousers which includes an outer shell comprising a right front panel, a right rear panel, a left front panel and a left rear panel, said right front panel and said right rear panel extending from a waistline to a lower edge of a right leg of the trousers, and said left front panel and a left rear panel extending from the waistline to a lower edge of a left leg of the trousers, said right front panel and said right rear panel being connected along a right outseam which is located in a rear of the outer shell and a right inseam which extends downwardly from a crotch point to a lower edge of the right leg, said right front panel being wider than the right rear panel when the right front and right rear panels are disconnected and flattened, and said left front panel and said left rear panel being connected along a left outseam which is located in a rear of the outer shell and a left inseam which extends downwardly from a crotch point to a lower edge of the left leg, said left front panel being wider than the left rear panel when the left front and left rear panels are disconnected and flattened out.

2. The fire protective trousers as defined in claim 1, wherein said inseam curves rearwardly to the lower edge of the right rear panel, and said left inseam curves rearwardly to the lower edge of the left rear panel.

3. The fire protective trousers as defined in claim 2, wherein when said pair of pants is vertically oriented relative to a flat flooring surface said right rear panel defines a concave lower edge relative to the flat flooring surface and said left real panel defines a concave lower edge relative to the flat flooring surface.

4. The fire protective trousers as defined in claim 2, wherein said right front panel includes upper and lower pleats that extend from said right outseam toward said right inseam and upper and lower pleats which extend from said right inseam toward said right outseam.

5. The fire protective trousers according to claim 4, wherein when said pair of pants is vertically oriented, said respective upper and lower pleats are generally horizontally aligned.

6. The fire protective trousers according to claim 5, wherein said right front panel includes a right knee pad and said upper and lower pleats extend towards said right knee pad.

7. The fire protective trousers according to claim 4, wherein said left front panel includes upper and lower pleats which extend from said left outseam toward said left inseam and upper and lower pleats which extend from said left inseam toward said left outseam.

8. The fire protective trousers according to claim 7, wherein when said pair of pants is vertically oriented, said upper and lower pleats are respectively generally horizontally aligned.

9. The fire protective trousers according to claim 8, wherein said left front panel includes a left knee pad and said upper and lower pleats in said left front panel extend towards said left knee pad.

10. The fire protective trousers according to claim 2, wherein said right front panel is connected to said left front panel along a center seam and wherein said right rear panel is connected to said left rear panel along a center rear seam, and wherein said center rear seam is at least 6 inches longer in length than said center front seam.

11. The fire protective trousers according to claim 10, including a removable liner mounted within said outer shell, said removable liner including an outer layer of a moisture barrier material and an inner layer of a thermal material.

12. The fire protective trousers according to claim 11, wherein said outer layer includes a right front panel, a right rear panel, a left front panel and a left rear panel, said right front panel and said right rear panel being connected along a right outseam which is located in a rear of the outer layer and said left front panel and said left rear panel being connected along a left outseam which is located in a rear of the outer layer.

13. The fire protective trousers according to claim 12, wherein said right front panel of said outer layer is connected to said right rear panel thereof along a right inseam which extends from a crotch area down a right leg portion of the outer layer and curves rearwardly to a lower edge of the right rear panel.

14. The fire protective trousers according to claim 13, wherein said left front panel of said outer layer is connected to said left rear panel thereof along a left inseam which extend from the crotch area down a left leg portion of the outer layer and curves rearwardly to a lower edge of the left rear panel.

15. The fire protective trousers according to claim 11, wherein each of said right front panel, right rear panel, left front panel and left rear panel of said outer layer define concave or cupped lower edges.

16. The fire protective trousers according to claim 15, wherein each of said right front and left front panels of said outer layer includes upper and lower darts which, with the liner mounted within the outer shell, are respectively positioned above and below the upper and lower pleats in the right front and left front legs of the outer shell.

17. The fire protective trousers according to claim 11, wherein said right front panel of said outer layer is connected to the left front panel thereof along a center front seam and said right rear panel of said outer layer is connected to the left rear panel thereof by a center rear seam, and wherein said center rear seam of said outer layer is longer than said center front seam thereof by at least six inches.

18. The fire protective trousers according to claim 17, wherein said inner layer includes a right front panel, a right rear panel, a left front panel and a left rear panel, and wherein said right front and left front panels of said inner layer respectively include upper and lower darts which are located below the respective upper and lower darts of said right and left front panels of said outer layer.

19. A pair of fire protective trousers which includes an outer shell comprising a right front panel, a right rear panel, a left front panel and a left rear panel, said right front panel and said right rear panel forming a right leg of the trousers, and said left front panel and a left rear panel forming a left leg of the trousers, said right front panel and said right rear panel being connected along a right outseam which is located in a rear of the outer shell and a right inseam which extends downwardly from a crotch point to a lower edge of the right leg, said right front panel being wider than the right rear panel when the right front and right rear panels are disconnected and flattened out, said left front panel and said left rear panel being connected along a left outseam which is located in a rear of the outer shell and a left inseam which extends downwardly from a crotch point to a lower edge of the left leg, said left front panel being wider than the left rear panel when the left front and left rear panels are disconnected and flattened out, wherein said right front panel includes upper and lower pleats which extend from said right outseam toward a right knee area and upper and lower pleats which extend from said right inseam toward said right knee area, and where said left front panel include upper and lower pleats which extend from said left outseam toward a left knee area and upper and lower pleats which extend from said left inseam toward said left knee area.

* * * * *